US006720883B2

(12) United States Patent
Kuhr et al.

(10) Patent No.: US 6,720,883 B2
(45) Date of Patent: Apr. 13, 2004

(54) WARNING DEVICE STATUS CIRCUIT INCLUDING A STATUS OUTPUT DEVICE

(75) Inventors: Hans J. Kuhr, Klamath Falls, OR (US); Tony J. Tewell, Nampa, ID (US)

(73) Assignee: Electronic Controls Company, Boise, ID (US)

( * ) Notice: Subject to any disclaimer, the term of this patent is extended or adjusted under 35 U.S.C. 154(b) by 32 days.

(21) Appl. No.: 10/139,611

(22) Filed: May 2, 2002

(65) Prior Publication Data

US 2002/0163438 A1 Nov. 7, 2002

Related U.S. Application Data

(60) Provisional application No. 60/288,631, filed on May 3, 2001.

(51) Int. Cl.[7] ..... G08B 21/00

(52) U.S. Cl. ..... 340/642; 340/458; 315/241 S; 315/200 R; 315/129

(58) Field of Search ..... 340/458, 642, 340/641; 315/241 S, 241 R, 200 A, 200 R, 129, 88, 119

(56) References Cited

U.S. PATENT DOCUMENTS

| | | | | |
|---|---|---|---|---|
| 4,068,216 A | | 1/1978 | Brouwer et al. | 340/168 R |
| 4,882,522 A | | 11/1989 | Brown | 315/119 |
| 5,266,840 A | | 11/1993 | Leipold et al. | 307/125 |
| 5,442,257 A | * | 8/1995 | Mitsumoto | 315/129 |
| 5,798,690 A | | 8/1998 | Grieser-Schmitz | 340/458 |
| 6,078,145 A | | 6/2000 | Tillinghast et al. | 315/241 S |
| 6,400,101 B1 | * | 6/2002 | Biebl et al. | 315/291 |
| 6,448,716 B1 | * | 9/2002 | Hutchison | 315/129 |

* cited by examiner

*Primary Examiner*—Nina Tong
(74) *Attorney, Agent, or Firm*—Joseph W. Holland

(57) ABSTRACT

A warning device including a status and function indicator circuit for indicating the status and function of the warning device. In a visual warning device such as a strobe light, the status and function indicator circuit includes a status output device such as an LED. The LED and associated circuitry are configured to indicate both proper operation of the visual warning device and, in the event of a device failure, will indicate whether the fault lies with circuitry for the visual warning device or simply with a warning output device.

10 Claims, 3 Drawing Sheets

WARNING DEVICE STATUS CIRCUIT INCLUDING A STATUS OUTPUT DEVICE

This application has claimed benefit under 35 USC Section 119(e) of the U.S. provisional application No. 60/288,631 filed May 3, 2001.

BACKGROUND OF THE INVENTION

1. Technical Field

The present invention relates generally to warning devices and more particularly to a warning device including a status and function indicator circuit having a visual indicator such as an LED for indicating the status and function of the device including a status output device.

2. Background

A wide variety of equipment, including mobile emergency, maintenance and law enforcement vehicles, employ warning devices including audible and visual signaling or warning devices. Audible warning devices may include back up or other devices intended to alert individuals to motion or other environmental conditions. Visual warning devices may include flashing or flash simulating devices. Flashing devices may include strobe lights that operate by illumination of a gas charged discharge tube. The discharge or flash tube is susceptible to failure and may require periodic servicing or replacement. Nevertheless, service personnel may assume that a failure of the flash tube is an indicator of a failure of some other component of the device and, rather than replacing the flash tube, will remove and replace the device with another unit.

It may be advantageous to provide a warning device including a status and function indicator circuit having a visual indicator such as an LED for indicating the status and function of the device. Similarly, it may be advantageous to provide a warning device including a status and function indicator circuit including a visually perceptible status output device.

SUMMARY OF THE INVENTION

The present invention is directed to a warning device including a status and function indicator circuit for indicating the status and function of the warning device.

The warning device comprises an output signal device. Warning devices may include audible and visual signaling or warning devices. Audible warning devices may include back up alarms or other devices intended to audibly alert individuals to motion or other environmental conditions. In an audible warning device, the output signal device comprises a transducer. Visual warning devices may include flashing or flash simulating devices. Flashing devices may include strobe lights that operate by illumination of a gas charged discharge tube. In a visual warning device, the output signal device comprises an incandescent bulb, a discharge tube or LED.

The status and function indicator circuit includes a status output device. In one embodiment of the invention, the status output device may be configured as a visually perceptible status output device, for instance, a light emitting diode (LED). The LED and associated circuitry is configured to indicate both proper operation of the visual warning device and, in the event of a device failure, will indicate whether the fault lies with circuitry for the visual warning device or simply with the flash tube.

DETAILED DESCRIPTION OF THE INVENTION

Figure 1:
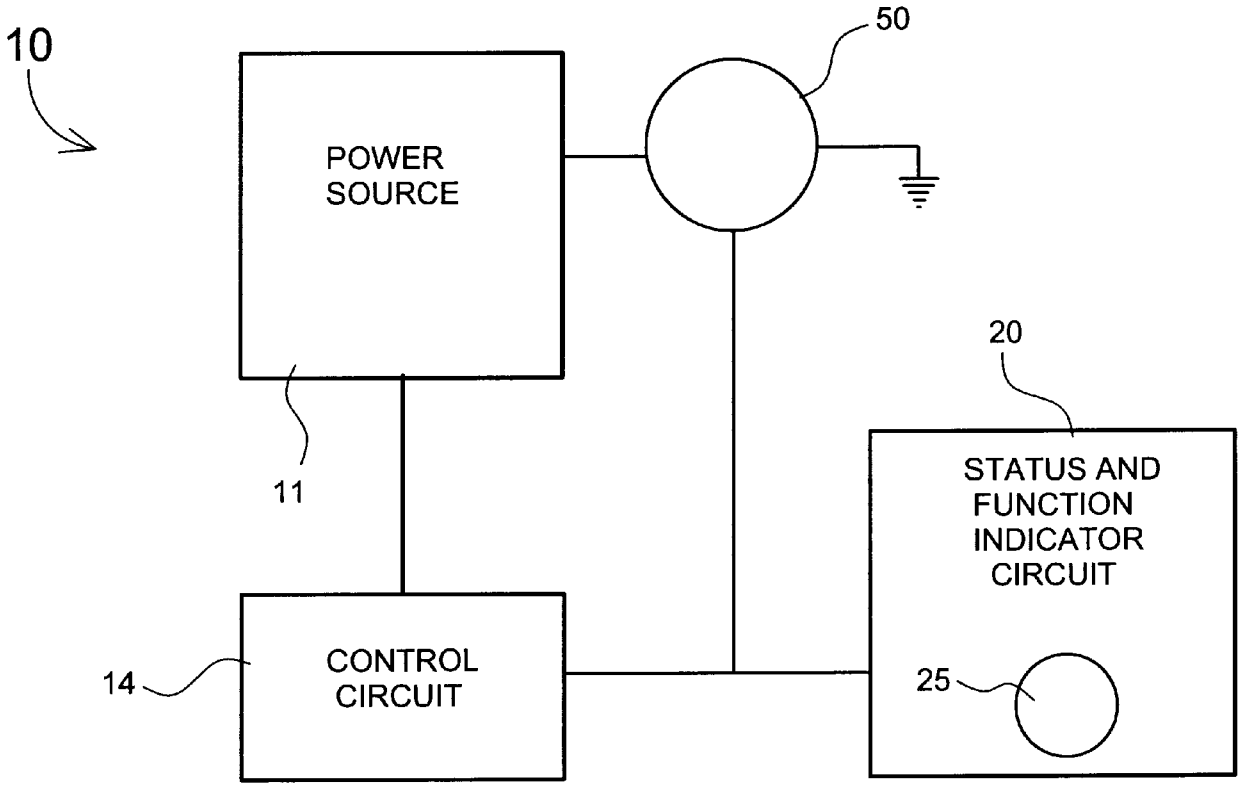
FIG. 1 is a block diagram of a warning device including a status and function indicator circuit.

FIG. 1 is a block diagram of warning device 10 including status and function indicator circuit 20. In the embodiment shown in FIG. 1, warning device 10 includes power source 11, control circuit 14 and output signal device 50 conductively connected to power source 11. Status and function indicator circuit 20 includes LED 25 and is conductively connected to control circuit 14 and output signal device 50.

Figure 2:
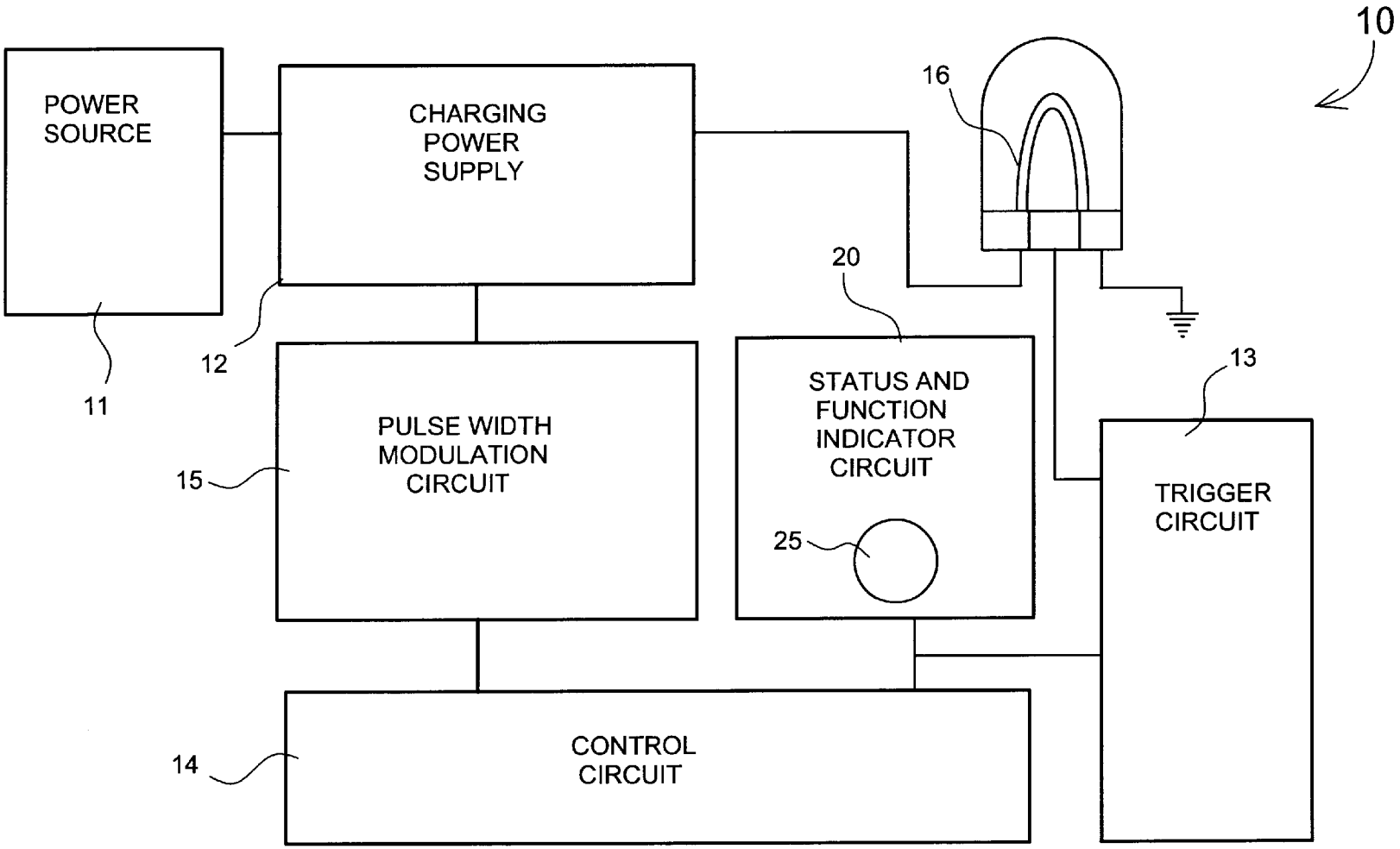
FIG. 2 is a block diagram of a visual warning device including a status and function indicator circuit.
Figure 3:
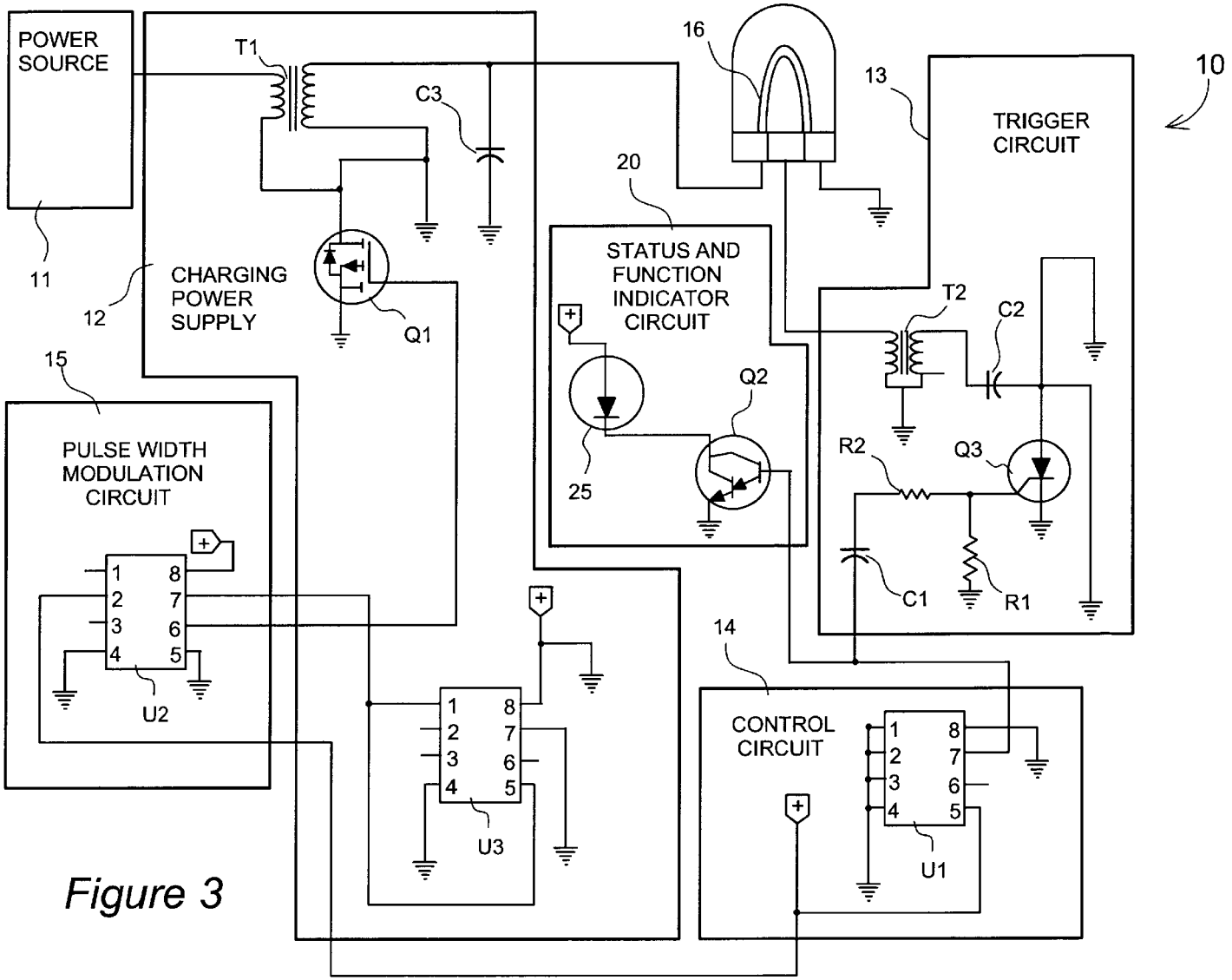
FIG. 3 is a block diagram of a visual warning device including a status and function indicator circuit.

Referring to FIGS. 2 and 3, visual warning device 10 includes power source 11. Charging power supply 12, trigger circuit 13, control circuit 14 and pulse width modulation circuit 15 are conductively connected to power source 11. Flash tube 16 is conductively connected to charging power supply 12 and trigger circuit 13. Status and function indicator circuit 20 includes LED 25 and is conductively connected to control circuit 14 and pulse width modulation circuit 15.

LED 25 is configured to indicate both proper operation of the visual warning device 10 (indicated by LED 25 firing in substantially simultaneous timing with flash tube 16) and, in the event of a device failure, will indicate whether the fault lies with circuitry for visual warning device 10 (indicated by the failure of LED 25 to illuminate), or simply with flash tube 16 (indicated by continued operation of LED 25), although flash tube 16 has ceased operation.

In one embodiment of the invention, visual warning device 10 incorporates a DC—DC Converter Technique in the Flyback Topology. Referring to FIG. 3, charging power supply 12 includes transformer T1 which is conductively connected to power source 11. In the embodiment shown, input voltage is stepped up to 450 volts (15.8 joules) for high intensity, and 360 volts (10 joules) for medium intensity, via transformer T1. MOSFET transistor Q1 chops up DC input voltage at a frequency of 15 KHz so that transformer action can take place.

Charging power supply 12 also includes regulator U3, which, in one preferred embodiment of the invention, may be configured as an LP2951 linear adjustable micropower adjustable voltage regulator 8 pin ceramic dual-in-line package. In the embodiment shown, input voltage is regulated to a maximum of 18.5 v. In the event that the flash tube 16 is either removed or defective, flash voltage stays at a preselected level while power is applied.

Control circuit 14 includes processor U1 which may be configured as a CMOS Microchip, in this case a 12C508 processor. Processor U1 has a built in 8 MHz reference clock used for all of its timing.

Processor U1 is conductively connected to and controls trigger circuit 13 and thereby the output characteristics including timing and duration of flashes, control of pattern characteristics including dual or quad operation and synchronization of output of visual warning device 10 with an output of a second conductively connected visual warning device (not shown). Trigger circuit 13 includes transformer T2 and associated triggering circuitry. Processor U1 of control circuit 14 produces trigger pulses, which are coupled through capacitor C1 to the voltage divider resistors R1 and resistor R2 which trigger pulses when differentiated by capacitor C1 and resistor R1 which fire silicon controlled rectifier Q3. When silicon controlled rectifier Q3 is turned on, it provides a ground path so that the energy in capacitor C2 will flow into primary winding of transformer T2. Energy is transferred to the secondary winding of transformer T2 as a high voltage spike (2–4 KV) thus providing a spark to ionize xenon gas in flash tube 16. During the time that the trigger pulses are on, they inhibit the output of high performance current mode controller U2 thus providing a resting period which turns MOSFET transistor Q1 fully off prohibiting charging of flash capacitor C3 to take place.

Pulse width modulation circuit 15 includes high performance current mode controller U2. High performance current mode controller U2 may be configured as a UC2845 high performance current mode controller. Processor U1 signals high performance current mode controller U2 of pulse width modulation circuit 15. The primary function of pulse width modulation circuit 15 is to control current going through the MOSFET transistor Q1 by controlling the gate voltage pulse width and repetition rate.

Status and function indicator circuit 20 includes LED 25 and flashing indicator transistor Q2. Processor U1 triggers silicon controlled rectifier Q3 driving flashing indicator transistor Q2 which in turn drives LED 25. LED 25 produces a flash and pause pattern consistent with the flash pattern of flash tube 16.

While this invention has been described with reference to the described embodiments, this is not meant to be construed in a limiting sense. Various modifications to the described embodiments, as well as additional embodiments of the invention, will be apparent to persons skilled in the art upon reference to this description, the drawings and the appended claims. It is therefore contemplated that the appended claims will cover any such modifications or embodiments as fall within the true scope of the invention.

We claim:

1. A visually perceptible warning device comprising:

a power source;

a charging power supply connected to the power source, the charging power supply including a linear adjustable micropower adjustable voltage regulator;

a control circuit conductively connected to the power source;

a strobe flash tube conductively connected to the power source and a trigger circuit; and a status and function indicator circuit conductively connected to the control circuit, the status and function indicator circuit including a status output device.

2. The visually perceptible warning device of claim 1, wherein the control circuit further comprises a voltage regulator conductively connected to the power source.

3. The visually perceptible warning device of claim 1 further comprising a pulse width modulation circuit conductively connected to the power source.

4. The visually perceptible warning device of claim 3 wherein the pulse width modulation circuit further comprises a current mode controller.

5. The visually perceptible warning device of claim 3 wherein the pulse width modulation circuit further comprises a current mode controller.

6. The visually perceptible warning device of claim 1 further comprising the trigger circuit conductively connected to the power source.

7. The visually perceptible warning device of claim 1 wherein the control circuit further comprises a processor.

8. The visually perceptible warning device of claim 1 wherein the charging power supply further comprises a voltage regulator.

9. The visually perceptible warning device of claim 1 wherein the output device further comprises an LED.

10. The visually perceptible warning device of claim 1 wherein the status and function indicator circuit further comprises a transistor.

* * * * *